United States Patent [19]

Payne et al.

[11] 4,396,520

[45] Aug. 2, 1983

[54] DETERGENT COMPOSITIONS

[75] Inventors: Nicholas S. Payne, Cincinnati; Keith A. Jones, Fairfield; Eugene J. Pancheri, Cincinnati, all of Ohio

[73] Assignee: The Procter & Gamble Company, Cincinnati, Ohio

[21] Appl. No.: 371,699

[22] Filed: Apr. 26, 1982

[51] Int. Cl.[3] ..... C11D 9/00; C11D 9/22

[52] U.S. Cl. ..... 252/89.1; 252/132; 252/174.17; 252/550; 252/554; 252/558

[58] Field of Search ..... 252/89.1, 132, 174.17, 252/550, 554, 558

[56] References Cited

U.S. PATENT DOCUMENTS

| | | | |
|---|---|---|---|
| 2,049,758 | 8/1936 | Bertsch et al. | 260/210 |
| 2,390,507 | 12/1945 | Cantor | 260/210 |
| 2,671,780 | 3/1954 | Gaver et al. | 260/234 |
| 2,671,781 | 3/1954 | Gaver et al. | 260/234 |
| 2,959,500 | 11/1960 | Schlapfer et al. | 127/37 |
| 2,974,134 | 3/1961 | Pollitzer | 260/209 |
| 3,092,618 | 6/1963 | Rosen et al. | 260/209 |
| 3,219,656 | 11/1965 | Boettner | 260/210 |
| 3,314,936 | 4/1967 | Ames | 260/209 |
| 3,346,558 | 10/1967 | Roth | 260/210 |
| 3,450,690 | 6/1969 | Gibbons et al. | 260/210 |
| 3,547,828 | 12/1970 | Mansfield et al. | 252/351 |
| 3,598,865 | 10/1971 | Lew | 260/210 |
| 3,640,998 | 2/1972 | Mansfield et al. | 260/210 |
| 3,707,535 | 12/1972 | Lew | 260/210 |
| 3,721,663 | 3/1973 | Ranauto | 252/527 |
| 3,737,426 | 6/1973 | Throckmorton et al. | 260/210 |
| 3,772,269 | 11/1973 | Lew | 260/210 |
| 3,839,318 | 10/1974 | Mansfield | 260/210 |
| 4,011,389 | 3/1977 | Langdon | 536/4 |
| 4,154,706 | 5/1979 | Kenkare et al. | 252/547 |
| 4,187,121 | 2/1980 | Herald et al. | 134/26 |
| 4,223,129 | 9/1980 | Roth et al. | 536/4 |
| 4,240,921 | 12/1980 | Kaniecki | 252/156 |
| 4,309,447 | 1/1982 | Tsutsumi et al. | 424/361 |

FOREIGN PATENT DOCUMENTS

| | | |
|---|---|---|
| 593422 | 2/1934 | Fed. Rep. of Germany . |
| 3001064 | 7/1981 | Fed. Rep. of Germany . |

OTHER PUBLICATIONS

Hughes et al., "Physical and Functional Properties of Some Higher Alkyl Polyglucosides", J. Amer. Oil Chem. Soc. 47, #5 (May 1970) pp. 162–167.

The Journal of the American Chemical Society, vol. 60, (Sep. 1938), pp. 2076–2077, Noller et al.

Nature, vol. 197, (Mar. 16, 1963) Schram et al.

Several Data Sheets, Rohm & Haas Co., Material Safety Data Sheet, Coded 6–1843; A Page Entitled "Manufacturing Specifications", Triton BG–10; A Specialty Chemicals Price List, Schedule CS–429,25; a Publication Entitled The Qualitative and Quantitative Determination of Triton BG–10 in Bottle Washing Formulations, Coded CS–400.

*Primary Examiner*—Mary F. Downey

*Attorney, Agent, or Firm*—Robert B. Aylor; Richard C. Witte; Thomas H. O'Flaherty

[57] ABSTRACT

Mixtures of specific alkyl polysaccharide detergent surfactants and calcium sensitive anionic detergent surfactants provide superior detergency.

15 Claims, No Drawings

DETERGENT COMPOSITIONS

DESCRIPTION OF THE PRIOR ART

Alkylpolyglycosides which are surfactants have been disclosed in U.S. Pat. Nos. 3,598,865; 3,721,633; and 3,772,269. These patents also disclose processes for making alkylpolyglycoside surfactants and built liquid detergent compositions containing these surfactants. U.S. Pat. No. 3,219,656 discloses alkylmonoglucosides and suggests their utility as foam stabilizers for other surfactants. Various polyglycoside surfactant structures and processes for making them are disclosed in U.S. Pat. Nos. 2,974,134; 3,640,998; 3,839,318; 3,314,936; 3,346,558; 4,011,389; 4,223,129. All of the above patents are incorporated herein by reference.

SUMMARY OF THE INVENTION

This invention relates to superior detergent compositions comprising:

(1) an alkylpolysaccharide detergent surfactant having the formula $RO(R^1O)_tZ_x$ wherein R is an alkyl, alkylphenol, hydroxyalkyl, hydroxy alkylphenol, or mixtures thereof and said alkyl groups contain from about 8 to about 18 carbon atoms, preferably from about 10 to about 14; wherein each $R^1$ contains from 2 to about 4 carbon atoms, preferably ethylene, propylene, and/or glyceryl; wherein t is from 0 to about 5, preferably from about 0 to about 2; wherein Z is a moiety derived from a reducting saccharide containing from 5 to 6 carbon atoms, preferably a glucose, galactose, glucosyl, or galactosyl residue or mixtures thereof, more preferably glucose; and wherein x is from about $1\frac{1}{2}$ to about 3, preferably from about $1\frac{1}{2}$ to about $2\frac{1}{2}$;

(2) a calcium sensitive anionic detergent cosurfactant, preferably one having the formula $$R(SO_3)_y(COO)_z(OSO_3)_nM_q$$

wherein R has the meaning given hereinbefore; y, z and n are numbers from 0 to about 4; y+z+n is from 1 to about 3, preferably 1, M is a cationic moiety; q is selected to complete the formula; and (3) from 0% to about 95% of a detergent builder, the ratio of (2) to (1) being from about 1:1 to about 6:1, preferably from about 2:1 to about 4:1, on a molar basis, and the free fatty alcohol content being less than about 2%, preferably less than about $\frac{1}{2}$%.

DESCRIPTION OF THE PREFERRED EMBODIMENT

The Alkylpolysaccharide Detergent Surfactant

It has surprisingly been found that the specific alkylpolysaccharide detergent surfactants of this invention not only provide excellent detergency themselves but by solubilizing the calcium sensitive anionic detergent cosurfactant the mixture provides superior cleaning. The alkylpolysaccharides are those having a hydrophobic group containing from about 8 to about 20 carbon atoms, preferably from about 10 to about 18 carbon atoms, more preferably from about 10 to about 16 carbon atoms. Preferably the hydrophobic group is an alkyl chain, most preferably saturated. The polysaccharide portion of the alkylpolysaccharide detergent surfactant is derived from reducing saccharides containing from 5 to 6 carbon atoms each. Examples of reducing saccharide moieties include, galactose, glucose, fructose, glucosyl, fructosyl and/or galactosyl moieties. It is essential that the average polysaccharide chain average from about $1\frac{1}{2}$ to about 3, more preferably from about $1\frac{1}{2}$ to about $2\frac{1}{2}$ saccharide units. Preferably the amount of alkylmonosaccharide present is from about 10% to about 60%, more preferably from about 20% to about 40% and the amount of alkyl polysaccharides having saccharide chains greater than 3 is preferably less than about 10%, more preferably less than about 5%, most preferably less than about 2%. The longer polysaccharide chains make the alkyl polysaccharide too water soluble for effective detergency, although they are still effective at preventing insoluble calcium anionic detergent surfactant formation. The saccharide moieties are normally attached to the hydrophobic group through the one position, but hydrophobic group can be attached at, e.g., the 2-, 3-, 4- or 6-positions, thus giving, e.g., a glucose or galactose as opposed to a glucoside or a galactoside. In the preferred product the additional saccharide units are attached to the previous saccharide units 2-position, although attachment can occur through the 3-, 4- and 6-positions.

Optionally and less desirably there can be a polyalkoxide, preferably a polyethoxide chain joining the hydrophobic moiety and the polysaccharide group.

Hydrophobic groups include alkyl groups, either saturated or unsaturated, branched or unbranced, preferably straight chain saturated. The alkyl group can contain up to 3 hydroxy groups as substituents and the polyalkoxide chain can contain up to about 3, preferably 1, most preferably no alkoxide moieties.

The preferred alkylpolyglycosides have the formula $ROZ_x$ wherein R, Z and x having the meanings given hereinbefore, preferably the alkyl group contains from about 12 to about 14 carbon atoms, and Z is derived from glucose. To prepare these compounds a long chain alcohol is reacted with, e.g., glucose, a short chain alkyl glucoside, etc., in the presence of an acid catalyst to form the desired glycoside (attachment at the 1-position).

Preferably the amount of fatty alcohol present should be less than about 2%, more preferably less than about 1%, most preferably less than about $\frac{1}{2}$%.

The Anionic Detergent Cosurfactants

In general anionic surfactants that are excellent detergents are also very calcium sensitive, more so than anionics that are poor detergents. Suitable calcium sensitive anionic detergents include the following:

Alkylbenzene Sulfonates

One of the preferred calcium sensitive detergent cosurfactants for use in this invention is an alkylbenzene sulfonate. The alkyl group can be either saturated or unsaturated, branched or straight chain and is optionally substituted with a hydroxy group. The alkyl group contains from about 6 to about 20, preferably from about 10 to about 13 carbon atoms. Suitable alkylbenzene sulfonates include $C_{13}$ alkylbenzene sulfonates with high 2-phenyl content. The preferred alkylbenzene sulfonates contain straight alkyl chain containing from about 10 to about 13 carbon atoms.

In all of the anionic cosurfactants described herein the cation is one which renders the anionic detergent surfactant water soluble or water dispersible, e.g., a cation selected from the group consisting of sodium, potassium, ammonium, mono-, di-, or triethanolammonium, calcium or magnesium or mixtures thereof.

Soap

Other anionic detergent surfactants are fatty acid soaps and similar surfactants. The soaps can be saturated or unsaturated and can contain various substituents such as hydroxy groups and alpha-sulfonate groups. Preferably the hydrophobic portion of the soap is a straight chain saturated or unsaturated hydrocarbon. The hydrophobic portion of the soap usually contains from about 6 to about 30 carbon atoms, preferably from about 10 to about 18 carbon atoms. Short chain soaps containing from about 10 to about 14 carbon atoms are especially preferred. Another preferred soap is oleate soap which forms a calcium soap that is easily dispersed.

Alkyl Sulfates and Sulfonates

Other preferred anionic detergent cosurfactants include alkyl sulfates and sulfonates derived from fatty alcohols, hydrocarbons, olefins, etc. These detergent surfactants typically have an alkylhydrophobic portion containing from about 6 to about 30 carbon atoms, preferably from about 10 to about 18 carbon atoms and a sulfate or sulfonate group. Suitable examples include $C_{14-15}$ alkyl sulfates, coconut alkyl sulfates, tallow alkyl sulfates, $C_{14-18}$ olefin sulfonates, $C_{14-15}$ paraffin sulfonates, etc. Sulfates of highly ethoxylated long chain fatty alcohols are also useful.

In general any anionic detergent surfactant which tends to form an insoluble compound with magnesium or calcium is useful herein.

The ratio of the alkyl polysaccharide to the anionic cosurfactant must be at least about 1:1, preferably from about 2:1 to about 6:1, most preferably from about 2:1 to about 4:1. The total of the two surfactants is from about 1% to about 99%, preferably from about 5% to about 40%, most preferably from about 10% to about 25%.

The mixture of the alkyl polysaccharide and the anionic cosurfactant provide superior performance, especially under high hardness conditions, low usage conditions, or in cool water.

Additional Ingredients

Desirably, the compositions of this invention contain from 0 to about 95% of a detergency builder, preferably an effective chelating builder that controls calcium and/or magnesium ions. Suitable builders are disclosed in U.S. Pat. No. 4,303,556, incorporated herein by reference. Preferred levels of builders are from about 5% to about 75%, more preferably from about 10% to about 60%.

The compositions and processes of this invention can utilize other compatible ingredients, including other detergent surfactants, in addition to the essential detergent surfactant mixture. In detergent compositions the compositions can contain any of the well known ingredients including minor amounts of other surfactants, detergency builders, soil suspending agents, brighteners, abrasives, dyes, fabric conditioning agents, hair conditioning agents, hydrotropes, solvents, fillers, etc. Suitable ingredients are disclosed in U.S. Pat. Nos. 4,166,039—Wise; 4,157,978—Llenado; 4,056,481—Tate; 4,049,586—Collier; 4,035,257—Cherney; 4,019,998—Benson et al; 4,000,080—Bartolotta et al; and 3,983,078—Collins, incorporated herein by reference. Listings of suitable additional ingredients, including low levels of other surfactants can be found in U.S. Pat. Nos. 4,089,945; 3,987,161; and 3,962,418, incorporated herein by reference.

Particularly preferred additives are conventional nonionic detergent surfactants as set forth in the copending application of Ramon A. Llenado, Ser. No. 306,640, filed Sept. 28, 1981, said application being incorporated herein by reference. Other preferred additives are conventional soil suspending and antiredeposition aids.

All percentages, parts, and ratios used herein are by weight unless otherwise specified.

The following nonlimiting examples illustrate the compositions of the present invention.

EXAMPLE I

An alkylpolysaccharide in which the alkyl group contains from 12 to 14 carbon atoms and the saccharide chain was a glucosyl chain averaging 1.7 glucosyl units ($C_{12-14}C_{1.7}$) was compared to an alkylpolysaccharide in which the alkyl group contained about 12 carbon atoms and the glucosyl chain averaged 3.8 units ($C_{12}G_{3.8}$) at various molar ratios to sodium $C_{14-15}$ alkyl sulfate. The surfactants were incorporated at a level of about 18.7% in a composition containing 25% sodium tripolyphosphate, 25% sodium carbonate, 8% sodium silicate (2.0r) 1% polyethyleneglycol (molecular weight 8,000) and the balance sodium sulfate. The product was used in 35° C. water containing 12 grains per gallon hardness at a total detergent level of 1,265 ppm. The wash sodium was used to clean standard swatches soiled with an artificial body soil in a mini washer. The percent soil removal was determined as follows:

| Polysaccharide to alkyl-sulfate weight ratio | 1 | 1½ | 2⅓ | 4 | 8 |
|---|---|---|---|---|---|
| $C_{12-14}G_{1.7}$ % removal | 54.5 | 53.5 | 57.5 | 57 | 45 |
| Mol ratio | .7 | 1 | 1.5 | 2.6 | 5.8 |
| $C_{12}G_{3.8}$ % removal | 49.5 | 48 | 45 | 45 | 46 |
| Mol ratio | .4 | .6 | .9 | 1.55 | 3.5 |

As can be seen from the above, the polysaccharide chain length should be less than about 3 and the molar ratio of alkyl polysaccharide to alkyl sulfate anionic cosurfactant should be less than about 4, preferably less than about 3 and greater than about ½, preferably greater than about 1. Similar results are obtained when the following surfactants are substituted either totally or in part for the sodium alkyl sulfate which contains from 14 to 15 carbon atoms: sodium, potassium, ammonium, monoethanolammonium, coconut alkyl sulfates, tallow alkyl sulfates, $C_{14-15}$ alkyl sulfonates, $C_{11-13}$ alkyl benzene sulfonates, coconut fatty acid soap, oleates, and mixtures thereof.

EXAMPLE II

The following is a spray-dried detergent granule:

| | % | Range |
|---|---|---|
| $C_{12-14}G_{1.7}$ | 12 | 10–15 |
| Sodium $C_{14-15}$ alkylsulfate | 4 | 3–5 |
| Sodium tripolyphosphate | 35 | 25–50 |
| Sodium carbonate | 20 | 10–30 |
| Polyethylene glycol | 1 | 0–2 |
| Water | 12 | 3–15 |
| Sodium sulfate | balance | balance |

These granules have good physical properties and are effective detergents. Unlike granules prepared with conventional ethoxylated nonionic detergent surfactants no special processing steps or processing aids are required for preparing such granules. Other calcium sensitive surfactants and detergency builders described hereinbefore can be substituted for the alkyl sulfate, sodium tripolyphosphate, etc. with substantially equivalent results in that the granules have improved physical properties as compared to similar products prepared with conventional nonionic detergent surfactants.

What is claimed is:

1. A detergent composition comprising:

(1) an alkylpolysaccharide detergent surfactant having the formula $RO(R^1O)_tZ_x$ wherein R is an alkyl, alkylphenol, hydroxyalkyl, hydroxy alkylphenol, or mixtures thereof, and said alkyl groups contain from about 8 to about 18 carbon atoms; wherein each $R^1$ contains from 2 to about 4 carbon; wherein t is from 0 to about 5; wherein Z is a moiety derived from a reducing saccharide containing from 5 to 6 carbon atoms; and wherein x is is from about $1\frac{1}{2}$ to about 3;

(2) a calcium sensitive anionic detergent cosurfactant; and (3) from 0% to about 95% of a detergent builder, the ratio of (2) to (1) being from about 1:1 to about 6:1 on a molar basis and the free fatty alcohol content being less than about 2%.

2. The composition of claim 1 wherein t is 0, and x is from about $1\frac{1}{2}$ to about $2\frac{1}{2}$.

3. The composition of claim 1 wherein said calcium sensitive anionic detergent cosurfactant has the formula $$R(SO_3)_y(COO)_z(OSO_3)_nM_q$$

wherein R has the meaning given hereinbefore; y, z and n are numbers from 0 to about 4; y+z+n is from 1 to about 3, M is a cationic moiety; and q is selected to complete the formula.

4. The composition of claim 3 wherein t is 0, x is from about $1\frac{1}{2}$ to about $2\frac{1}{2}$.

5. The composition of claim 4 wherein said alkyl groups contain from about 10 to about 14 carbon atoms, and Z is selected from the group consisting of glucose, galactose, glucosyl, and galactosyl residues and mixtures thereof.

6. The composition of claim 5 wherein Z is derived from glucose.

7. The compositions of claims 4, 5 or 6 wherein the anionic detergent cosurfactant is an alkyl sulfate containing from about 6 to about 30 carbon atoms.

8. The compositions of claims 4, 5 or 6 wherein the anionic detergent cosurfactant is an alkyl sulfonate containing from about 6 to about 30 carbon atoms.

9. The compositions of claims 4, 5 or 6 wherein said anionic detergent cosurfactant is an alkyl benzene sulfonate in which the alkyl contains from about 6 to about 20 carbon atoms.

10. The compositions of claims 4, 5 or 6 wherein said anionic detergent cosurfactant is a fatty acid soap containing from about 6 to about 30 carbon atoms.

11. The composition of claim 1 wherein the ratio of (2) to (1) is from about 2:1 to about 4:1.

12. The compositions of claim 11 wherein the anionic detergent cosurfactant is an alkyl sulfate containing from about 6 to about 30 carbon atoms.

13. The compositions of claim 11 wherein the anionic detergent cosurfactant is an alkyl sulfonate containing from about 6 to about 30 carbon atoms.

14. The compositions of claim 11 wherein said anionic detergent cosurfactant is an alkyl benzoate sulfonate in which the alkyl contains from about 6 to about 20 carbon atoms.

15. The composition of claim 11 wherein said anionic detergent cosurfactant is a fatty acid soap containing from about 6 to about 30 carbon atoms.

* * * * *

UNITED STATES PATENT AND TRADEMARK OFFICE

CERTIFICATE OF CORRECTION

PATENT NO. : 4,396,520

DATED : August 2, 1983

INVENTOR(S) : Nicholas S. Payne et al

It is certified that error appears in the above-identified patent and that said Letters Patent is hereby corrected as shown below:

Column 6, line 30, Claim 14, "benzoate" should be -- benzene --.

Signed and Sealed this

*Twentieth* Day of *November 1984*

[SEAL]

*Attest:*

GERALD J. MOSSINGHOFF

*Attesting Officer*

*Commissioner of Patents and Trademarks*